US010091576B2

(12) United States Patent
Ball

(10) Patent No.: US 10,091,576 B2
(45) Date of Patent: Oct. 2, 2018

(54) IN-EAR MONITOR

(71) Applicant: Campfire Audio LLC, Portland, OR (US)

(72) Inventor: Kenneth Ball, Portland, OR (US)

(73) Assignee: Campfire Audio LLC, Portland, OR (US)

( * ) Notice: Subject to any disclaimer, the term of this patent is extended or adjusted under 35 U.S.C. 154(b) by 432 days.

(21) Appl. No.: 15/045,183

(22) Filed: Feb. 16, 2016

(65) Prior Publication Data

US 2017/0238085 A1 Aug. 17, 2017

(51) Int. Cl.

| | |
|---|---|
| ***H04R 1/26*** | (2006.01) |
| ***H04R 1/28*** | (2006.01) |
| ***H04R 1/10*** | (2006.01) |
| ***H04R 29/00*** | (2006.01) |
| *H04R 11/02* | (2006.01) |

(52) U.S. Cl.
CPC ..... *H04R 1/26* (2013.01); *H04R 1/1075* (2013.01); *H04R 1/2842* (2013.01); *H04R 29/001* (2013.01); *H04R 1/1016* (2013.01); *H04R 11/02* (2013.01)

(58) Field of Classification Search
CPC ..... H04R 1/1015
USPC ..... 381/380
See application file for complete search history.

(56) References Cited

U.S. PATENT DOCUMENTS

| | | | | |
|---|---|---|---|---|
| 6,310,961 | B1 | 10/2001 | Oliveira et al. | |
| 7,317,806 | B2 | 1/2008 | Harvey et al. | |
| 8,548,186 | B2 * | 10/2013 | Alwicker | H04R 1/1058 381/371 |
| 8,567,555 | B2 * | 10/2013 | Harvey | H04R 1/1016 181/129 |
| 8,897,463 | B2 * | 11/2014 | Harvey | H04R 1/1016 381/151 |
| 8,983,101 | B2 * | 3/2015 | Grinker | H04R 1/1016 381/322 |
| 9,042,585 | B2 * | 5/2015 | Chang | H04R 1/26 181/129 |
| 9,055,366 | B2 * | 6/2015 | Azmi | H04R 1/1075 |
| 9,338,543 | B2 | 5/2016 | Huang | |
| 2006/0133636 | A1 * | 6/2006 | Harvey | H04R 1/1016 381/380 |
| 2010/0310106 | A1 * | 12/2010 | Blanchard | H04R 1/1075 381/351 |
| 2011/0058702 | A1 * | 3/2011 | Saggio, Jr. | H04R 1/1016 381/380 |
| 2017/0213646 | A1 | 7/2017 | Yializis | |

FOREIGN PATENT DOCUMENTS

| | | | | |
|---|---|---|---|---|
| CN | 102361503 A | * | 2/2012 | H04R 11/02 |
| CN | 102361503 A | | 2/2012 | |

* cited by examiner

*Primary Examiner* — Jason C Olson

(74) *Attorney, Agent, or Firm* — SoCal IP Law Group LLP; Steven C. Sereboff; William Campbell

(57) ABSTRACT

An in-ear monitor that incorporates high frequency balanced armature driver tuning, both low frequency dynamic driver and balanced armature driver tuning, mid range and high range frequency balanced armature driver tuning. It also utilizes a spout that has a series of stanchions or stanchions and resonator box cavities for the simplified connection and disconnection of sound tubes and resonator boxes.

16 Claims, 13 Drawing Sheets

FIG. 9
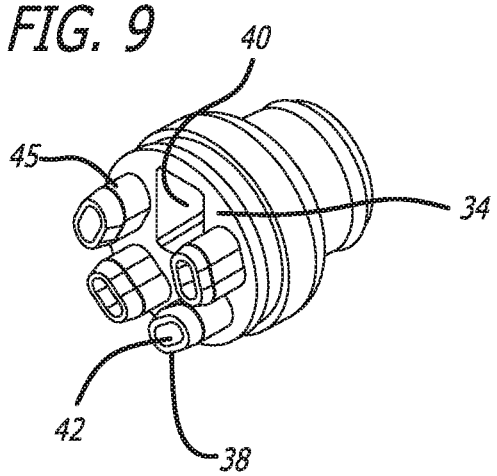
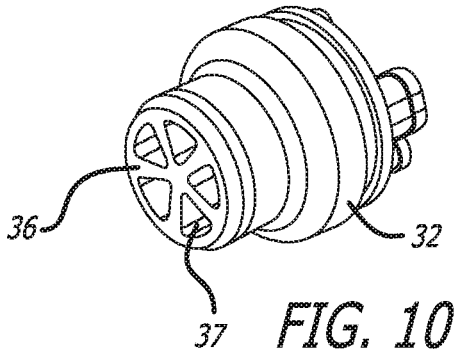
FIG. 10
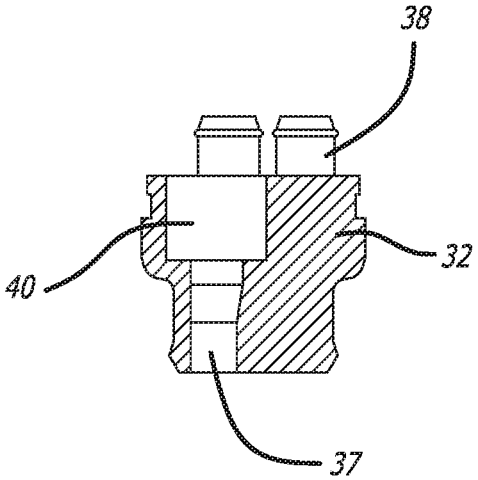
FIG. 11
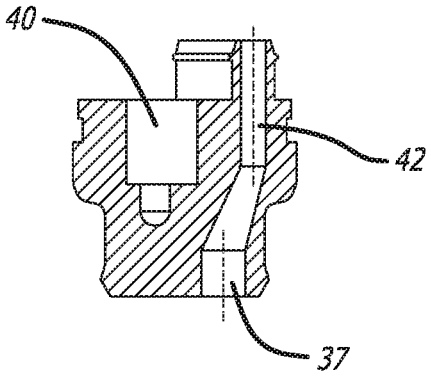
FIG. 12

IN-EAR MONITOR

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

RELATED APPLICATION INFORMATION

This patent is related to application Ser. No. 15/473,329 filed Mar. 29, 2017 entitled IN-EAR MONITOR.

FIELD

The present disclosure relates, in general, to in-ear monitors, and more particularly to improved frequency response in-ear monitor (ear phone) technology.

BACKGROUND

Today more than ever, the average American relies heavily on his handheld consumer electronics. This includes the entire gamut from cell phones, to computers and tablets, and to personal audio or audio/video devices. Audio headsets, especially in-ear monitors are the preferred mode of auditory transfer. They can be seen plugged into the ears of public transportation commuters and gym attendees to name but a few. With the sophistication of audio development at hand, it is no wonder that the consumer wants a device to allow them to experience these new levels of sound clarity and frequency response.

Henceforth, an improved in-ear monitor that is simpler to assemble and has an audio frequency tuneability that enhances the sound exiting the spout and delivered to the wearer, would fulfill a long felt need in the audio industry. This new invention utilizes and combines known and new technologies in a unique and novel configuration to overcome the aforementioned problems and accomplish this. Thus, an in-ear monitor with improved sound output is provided by the embodiments set forth below.

BRIEF SUMMARY

In accordance with various embodiments, an improved in-ear monitor and method of high frequency driver tuning with a resonator box as well as low frequency driver tuning via a back pressure port, are provided.

The term "dual" with respect to high, full, mid and low frequency drivers refers to a pair of these drivers that have been joined into a single unit either by affixation of two individual drivers together or by incorporation of two individual drivers into a single enclosure.

In one aspect, an in-ear monitor with a tunable high frequency sound output is provided. In various embodiments, differing combinations of acoustic drivers are combined within the in-ear enclosure in geometric configurations designed for rapid assembly and minimal spatial complexity.

In another aspect, an in-ear monitor is provided, capable of allowing the adjustment of the device's sensitivity, especially in the high frequency response region between 2,000 Hz and 20,000 Hz (the upper limit of human hearing).

In yet another aspect, an economical, simple method of tuning the high frequency response of the high frequency drivers in an in-ear monitor is provided.

In a final aspect, an in-ear monitor with a spout configured for the simplified, removable attachment of sound tubes and resonator boxes to the spout.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components. In some instances, a sub-label is associated with a reference numeral to denote one of multiple similar components. When reference is made to a reference numeral without specification to an existing sub-label, it is intended to refer to all such multiple similar components.

FIG. 9 is a rear perspective view of a spout;

FIG. 10 is a front view of a spout;

FIG. 11 is a cross sectional view of the spout taken through the center of the resonator box cavity;

FIG. 12 is a cross sectional view of the spout taken through the center of a sound tube bore;

DETAILED DESCRIPTION OF CERTAIN EMBODIMENTS

Figure 1:
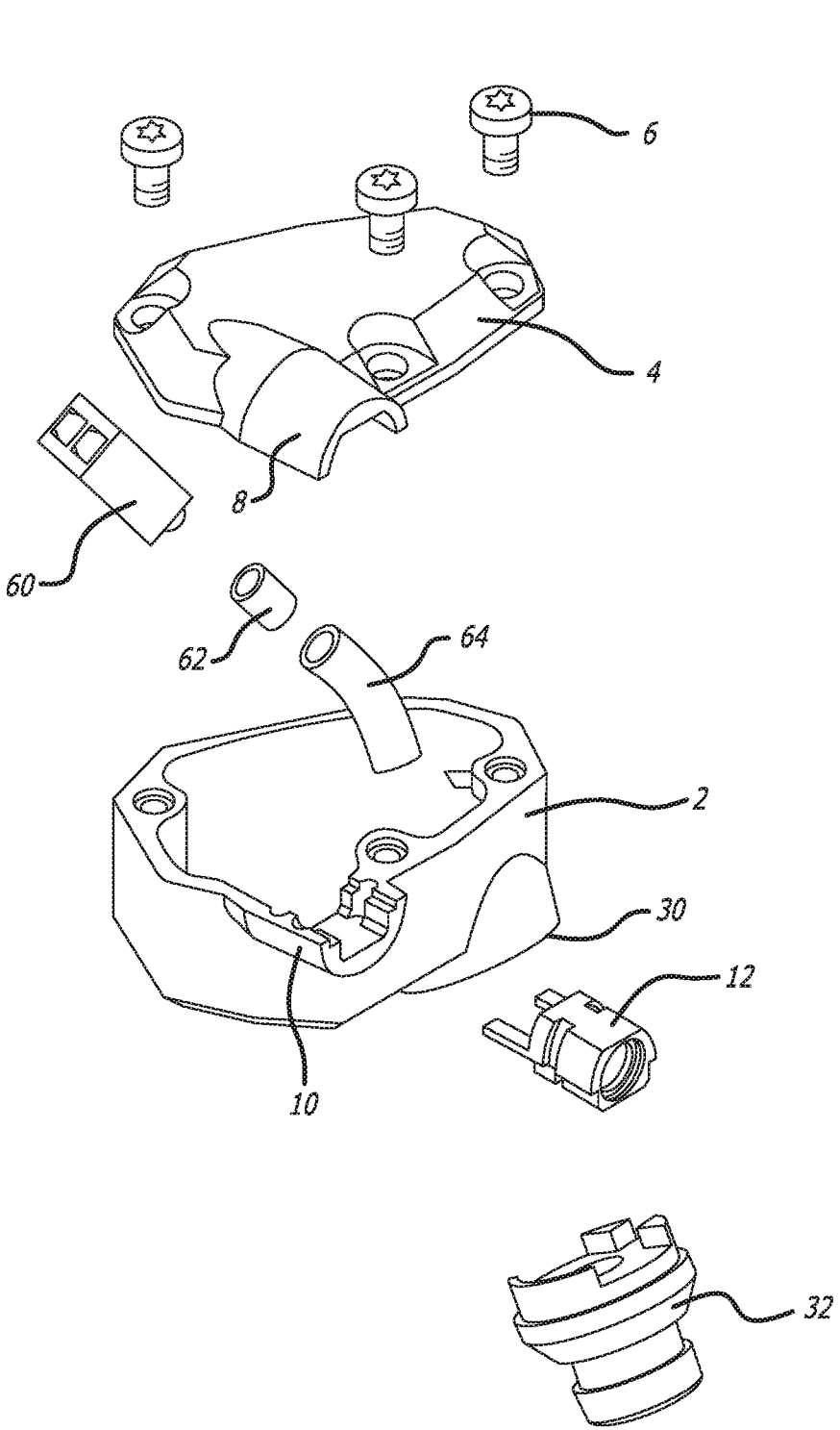
FIG. 1 is an exploded, front perspective view of a first embodiment in-ear monitor with a single full frequency balanced armature driver.

While various aspects and features of certain embodiments have been summarized above, the following detailed description illustrates a few exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

The term "in-ear monitor" as used herein refers to a single headphone/earphone unit. It may be a right or left side unit. Generally, these units are used as pairs of left and right in-ear monitors.

The term "spout" as used herein refers to the tip of the in-ear monitor that disperses the sound generated by the drivers within the in-ear monitor housing to the users eardrum by the insertion of the spout into the ear canal. The spout has orifices formed there through to allow the sound pass through from the enclosed cavity of the in-ear monitor housing to the outside environment.

The term "crossover component" as used herein refers to any of a host of passive electrical components that alters the electrical signal to the drivers to allow the driver to output a sound frequency in a desired frequency response range. Frequently, this is accomplished by a capacitor.

The term "high frequency" as used herein refers to the range of sound in the region of 4,000 Hz to 20,000 Hz plus or minus 500 Hz. This encompasses two of the conventional seven frequency bands, that of presence (4,000 Hz-6,000 Hz) and brilliance (6,000 Hz-20,000 Hz)

The term "full frequency" as used herein refers to the range of sound in the region of approximately 20 Hz to 20,000 Hz covering all conventional seven frequency bands.

The term "low frequency" as used herein refers to the range of sound in the region of 20 Hz to 250 Hz. This encompasses two of the conventional seven frequency bands, that of the sub bass (20 Hz-60 Hz) and the bass (60 Hz-250 Hz).

The term "mid range frequency" as used herein refers to the range of sound in the region of 250 Hz to 4,000 Hz. This encompasses three of the conventional seven frequency bands, that of the lower midrange (250 Hz-500 Hz), midrange (500 Hz-2,000 Hz) the upper midrange (2,000 Hz-4,000 Hz)

The term "circuit" or "electrical circuit" as used herein means an electrical circuit operationally connected to provide input audio signals, (either directly or indirectly through a crossover component) to all the drivers in an in-ear monitor from an external audio source, (generally an audio signal amplifier) so as to enable the generation of an output sound from the drivers in the in-ear monitor.

The term "driver" as used herein refers to a miniaturized speaker either of the dynamic design or of the balanced armature design. It may operate in all of any of the seven conventional frequency bands based on its design, connected crossover components or input signals.

The present invention relates to a series of novel designs for an improved in-ear monitor that incorporates high frequency driver tuning, low frequency driver tuning and an improved design for connection of sound tubes and resonator boxes to the in-ear monitor's spout.

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture, but instead can be implemented on any suitable hardware, firmware, and/or software configuration. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

The series of tunable in-ear monitors share any combination of the following elements that are combined in specific combinations to achieve a specific spectrum of frequency response. In this way the in-ear monitors can be tuned for select genres of music. It also allows for the in-ear monitors to be configured for specific target retail price levels. The in-ear monitor has a generic enclosure that houses the elements. The elements shared between the various in-ear monitors in the series are: full frequency drivers, high frequency drivers, mid range frequency drivers, two types of low frequency drivers, sound tubes, resonator boxes, dampeners, crossover components, a spout, an electrical connector socket, and an operational circuit.

In FIG. 1, the simplest, first embodiment of the in-ear monitor can best be seen in a perspective, exploded illustration. A full frequency balanced armature driver 60 has a sonic dampener 62 affixed about its sound outlet port 64. The dampener 62 generally is a metal tube capable of retaining various mesh sized screens therein. The different mesh screens are used to tune the frequency response of the sonic dampener in the balanced armature full range frequency driver (as well as in balanced armature low frequency drivers.) The dampener 62 is frictionally fitted into a sound tube 64 (at any depth along the length of the tube) which has its distal end frictionally engaged into the spout 32 (FIG. 10). The electrical socket 12 introduces the electrical, operational circuit into the in-ear monitor from the external audio source.

Viewed from any of the exploded front perspective views of FIGS. 1 through 8, it can be seen that the housing is made of a housing body 2 and a lid 4. When these are attached mechanically by a series of threaded fasteners 6, or attached chemically about their periphery they form a dustproof, sealed enclosure within which to house the operational components of the in-ear monitor. From the lid 4 there extends outward a first half of a clamshell capture fitting 8 that matingly engages a second half clamshell capture fitting 10 that similarly extends from the housing body 2. When the lid 4 and body 2 are connected, this assembled clamshell capture fitting circularly compresses about and retains an electrical socket 12 that introduces the electrical circuit from the external audio signal source (via an audio cable) into any drivers and crossover components within the housing. The housing body 2 and lid 4 are made of aluminum in the preferred embodiment although there is a plethora of other materials such as LiquidMetal™ or any of a host of polymers or metal alloys. Aluminum is both lightweight and soft enough to avoid "tinning" any of the combined audio output resonating from the enclosure's cavity. Although not illustrated, a polymer gasket may be sandwiched between the lid 4 and the housing body 2 during assembly.

Figure 13:
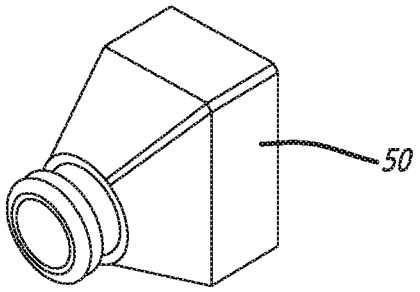
FIG. 13 is a rear perspective view of a resonator box.
Figure 14:
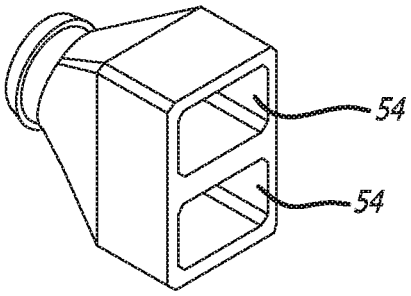
FIG. 14 is a front perspective view of a split resonator box.
Figure 15:
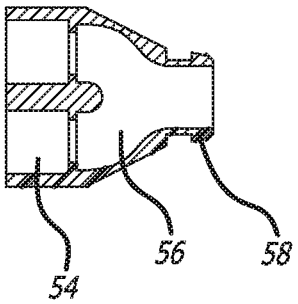
FIG. 15 is a cross sectional view of a split resonator box.

The back side of the housing body 2 (FIG. 1) also has a spout opening 30 to accommodate the frictional engagement of a spout 32 therein. Looking at FIGS. 9-12 it can be seen that the spout 32 has an inner face 34 and an outer face 36 separated by a thickness of spout material. On the inner face 34 are a series of miniature stanchions 38 extending normally therefrom. There is also a resonator box cavity 40 formed into the thickness of the spout 32 downward from the inner face 34. There is a series of through bores 42 drilled through the thickness of the spout that extend out of the outer face 36 and extend through both the resonator box cavity 40 and the stanchions 38. The outer face 36 has a series of openings 37 axially spaced about the midpoint of the outer face that are connected to the through bores 42 in the thickness of the spout material. These openings may vary in size and geometric configuration for the tenability of the outlet sound. The stanchions 38 generally are cylindrical in configuration with a circular or oval cross section, and their cylindrical side wall resides concentric to their through bores 42. About the periphery of the stanchions 38 are circumferential ribs 45 to frictionally secure and retain the inside wall of the sound tubes that are connected to the spout 32. It is to be noted that not all spouts will have a resonator box cavity 40, rather there may be an additional stanchion 38 in its place. (This can be seen comparing the spout of the second, third, sixth, seventh or eighth embodiments (FIGS. 2, 3 and 6 to 8) to the spout of the fourth or fifth embodiments (FIGS. 4 and 5).) This is for attachment to a sound tube where there is a yoke style resonator box 50 (either single of dual cavity) for the connection of a sound tube between the high frequency driver and the spout 32. (FIGS. 13-15)

In alternate embodiments the spout 32 may have any combination of orifices for sound tube or resonator box insertions and any number stanchions for sound tubes or dual driver yoke resonator box attachment.

Figure 16:
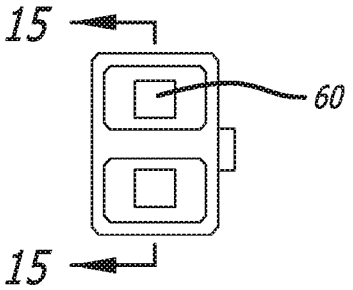
FIG. 16 is a front view of a split resonator box.
Figure 17:
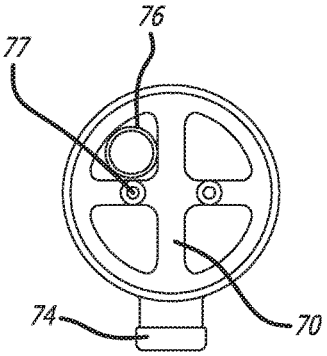
FIG. 17 is a front view of the dynamic driver housing.
Figure 18:
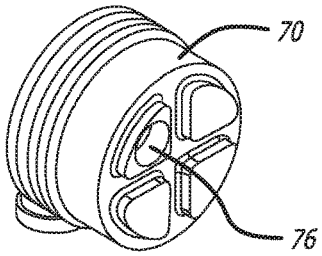
FIG. 18 is a perspective view of a dynamic driver enclosure.
Figure 19:
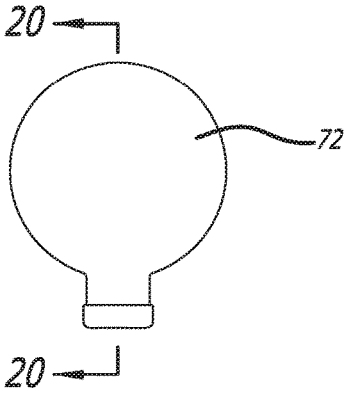
FIG. 19 is a rear view of a dynamic driver enclosure.
Figure 20:
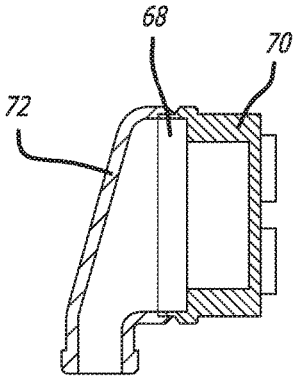
FIG. 20 is a cross sectional view of a dynamic driver taken through section BB of FIG. 19.

The resonator box has two basic configurations. The first configuration is a rectangular cube 51 (FIG. 2) with one fully open face and the opposing planar face having a sizeable orifice formed there through sized for mating engagement within resonator box cavity 40 in the spout 32. The second configuration is a dual driver yoke 50 (FIGS. 13-16) where the face opposing the open face funnels into a nipple for the attachment to a sound tube that will be fitted onto a stanchion 38 extending from the spout 32. Either of these configurations may define a single volume or a dual volume 54 and either may be used with a single or a dual driver. In the dual volume model, there is an additional wall, splitting the volume of the resonator box into two, and each sound outlet slit port in the high frequency driver will have its own volume for mixing its sound. In the single volume model, the sound from the sound outlet slit port in a dual high frequency driver will mix. Where there is a dual volume as in the dual driver yoke model 50, there is a Y cavity 56 that joins the output of the two resonator volumes 54 into a common sound tube connector 58. (FIG. 15) However, in all of the volumes, the opposing face will have a sizeable sound outlet orifice 60 that can be sized to tune the sound. (FIG. 16) The resonator box is fabricated from a polymer preferably from a UV photopolymer resin such as PlasPINK™. In both configurations the volume of the resonator box is directly affixed to the high frequency driver, around (concentric to) the sound outlet slit port of the driver, generally by an adhesive.

The electrical socket 12 (FIGS. 1 and 5) has a distal end with a set of electrical connection leads that extend into the housing and are hard wired for operational contact with the drivers and any crossover components 78 (FIGS. 2 through 5) used in conjunction with the high frequency drivers 16. Generally, an audio cable has one of its two ends operatively connected to the electrical socket 12 and its other end operationally engaged with an external audio source. The audio input signals are split at the electrical socket 12 with one set going to the input of the balanced armature low frequency driver 66 (FIG. 2) or full frequency driver 60, and the other set going to a crossover component 78 that filters the frequency of the audio signal that is then passed to the input of the high frequency driver 16 (although it is known that this may be added to the mid and low frequency range drivers as well.) Alternatively, the signals may be wired in series between the aforementioned components. In this way, an operational electrical circuit is established between the external audio source and the drivers of the in-ear monitor.

The low frequency driver may be of either a balanced armature driver 66 (FIG. 2) or a dynamic driver 68 (FIGS. 6 and 17-20) and either output sound approximately in the 20 Hz to 250 Hz frequency range. The choice is determined by both cost and the desired frequency response of the bass sound generated. Generally, the balanced armature low frequency driver 66 is a pair of ganged individual low frequency miniature balanced armature speakers that have been mechanically conjoined to a single unit. They have a single sound outlet port around which the sonic dampener 62/sound tube 64 combination is adhesively affixed. The dynamic low frequency driver 68 is a single driver unit wherein the driver 68 is sandwiched in a two part clamshell-like cover having a tunable back cover 70 and a front cover 72 having a circular neck 74 for the attachment to a sound tube 64. Similar to the stanchions 38 on the spout 32, the neck 74 has a rib 45 to retain a sound tube 64. The back cover 70 has a sizeable orifice 76 formed therethrough that is dimensioned to increase or decrease the amount of back pressure exerted on the dynamic driver as it moves. The orifice 76 may also have any of a different mesh sized screens placed therein to adjust the flow of air into the volume in the clamshell. Thus there are two mechanisms of adjusting the frequency response of the dynamic driver 68. That of altering the port size of the mesh size of any screen used in the port. There are two wiring ports 77 that allow the circuit to be brought from the connector 12 to the dynamic driver 68.

Figure 4:
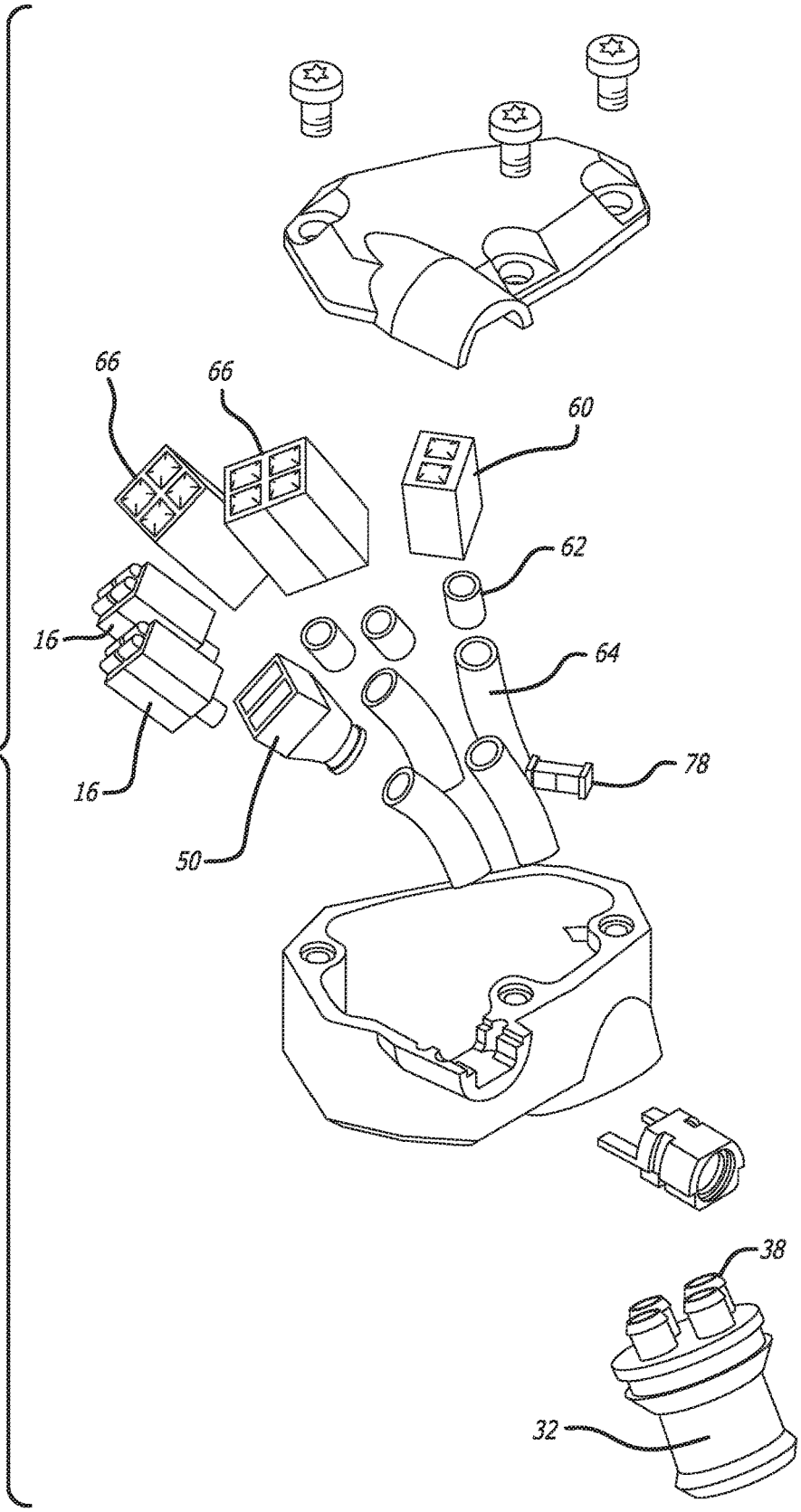
FIG. 4 is an exploded, front perspective view of a fourth embodiment in-ear monitor with two dual high frequency balanced armature drivers, two dual low frequency balanced armature drivers and a single mid range frequency driver.
Figure 22:
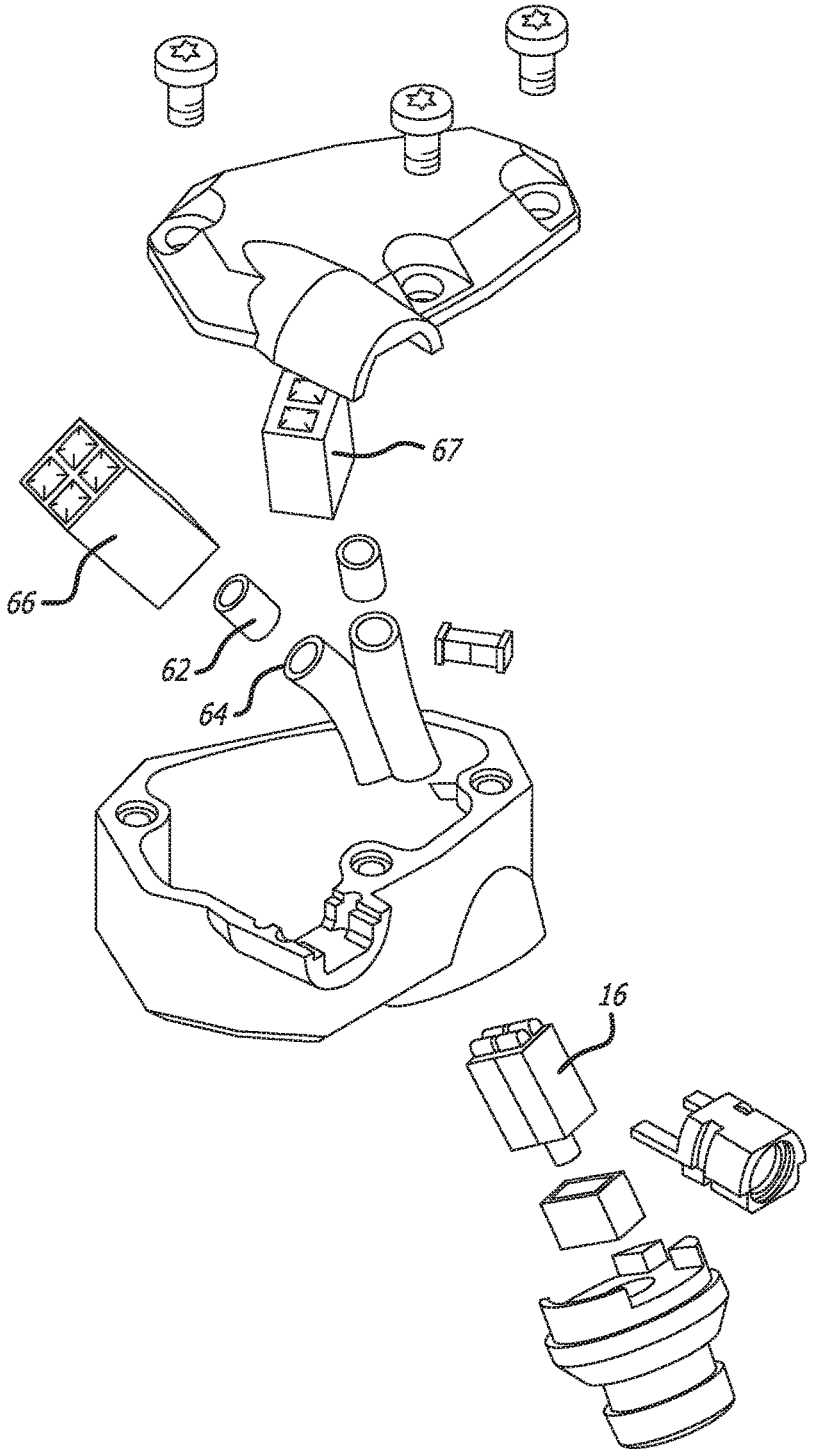
FIG. 22 is an exploded front perspective view of a ninth embodiment in-ear monitor with a dual low frequency balanced armature driver, a mid range balanced armature driver and a dual high frequency driver.

Comparing the ninth embodiment of FIG. 22 with the fourth embodiment of FIG. 4, it can be seen that the balanced armature low frequency driver 66 has a sonic dampener 62 affixed about its outlet port that functions identically to that used with the balanced armature full frequency driver 60 above. It is known that the sonic dampener 62 may be placed at any length along the sound tube 64 and the sound tube 64 affixed about the outlet port. Thus is another method of frequency response tuning.

The high frequency driver 16 generally is a pair of individual high frequency miniature balanced armature speakers that also have been mechanically conjoined to a single unit. Each of the two drivers have their own sound outlet slit ports and output sound generally in the 4,000 to 20,000 Hz frequency range. The larger conjoined high frequency driver units are utilized in higher end in-ear monitors and are useful to save space within the in-ear housing enclosure. The operational circuit provides the audio signal from the external audio source to a crossover component 78 then to the high frequency driver 16 as is well known by one skilled in the art. A resonator box in any of its configurations 50 or 51, is affixed about the sound outlet slit ports in the dual high frequency drivers 16. The resonator box is tunable by altering either its enclosed volume of the dimension of its outlet port.

The preferred method of affixation of the resonator boxes to the high frequency drivers 16 or of affixing the sonic dampeners 62 to the low frequency drivers is with a soft, low durometer epoxy. This allows for shock protection.

Figure 7:
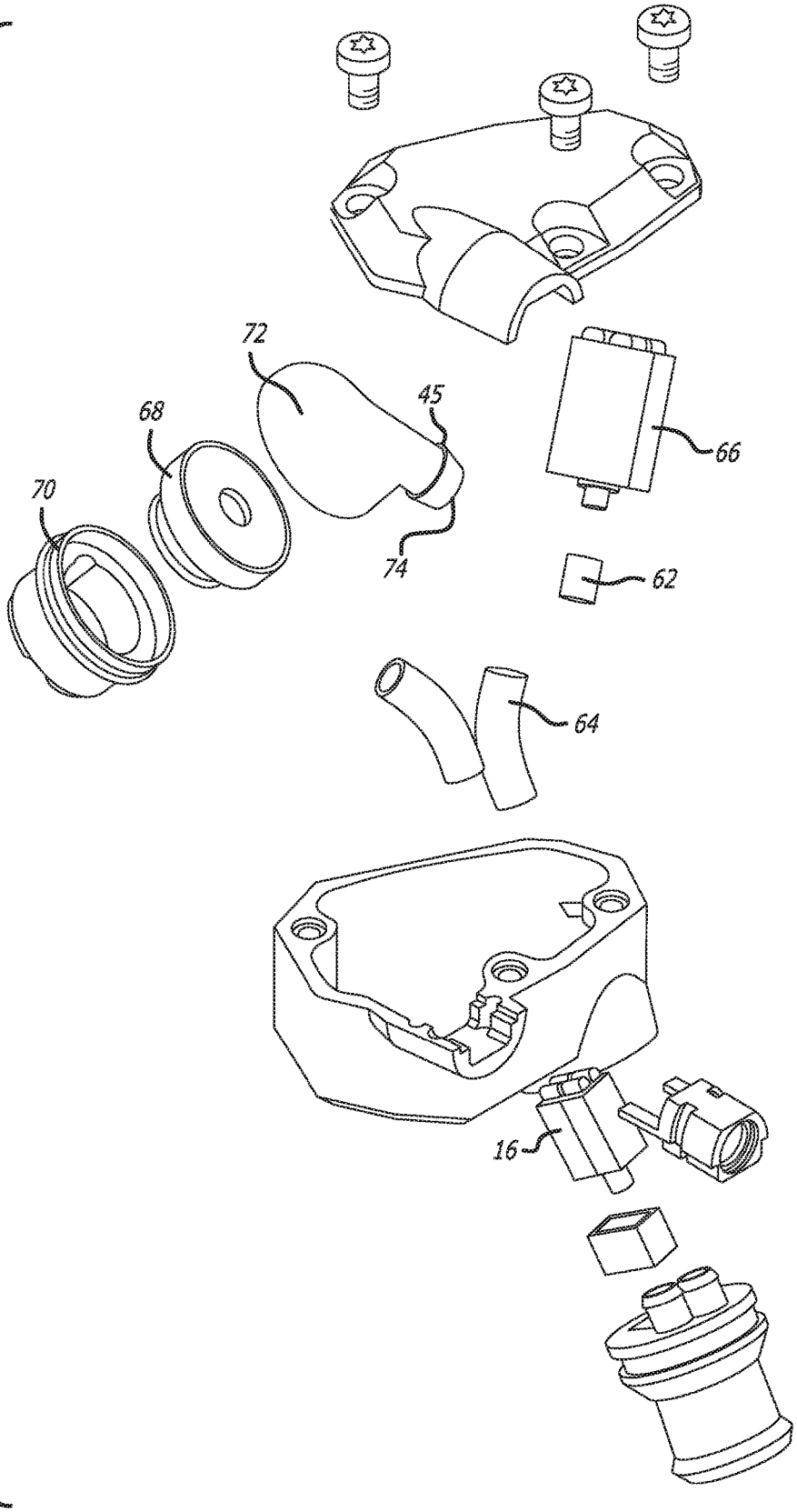
FIG. 7 is an exploded, front perspective view of a seventh embodiment in-ear monitor with a dual high frequency armature driver, one dual low frequency armature driver and a single low frequency dynamic driver.

Looking at the seventh embodiment of FIG. 7 it can best be seen that onto the balanced armature low frequency driver 66 concentric to its single sound outlet port is glued a sonic dampener 62 which is generally a metal cylinder with a mesh screen perpendicularly disposed therein. Over the sonic dampener 62 is frictionally fitted a sound tube 64. This is a elastically deformable hollow polymer tube having an internal diameter that accommodates the frictional insertion of the body of the sonic dampener 22 therein. The other end of the sound tube is frictionally fitted over one of the stanchions 38 on the spout 32.

Figure 2:
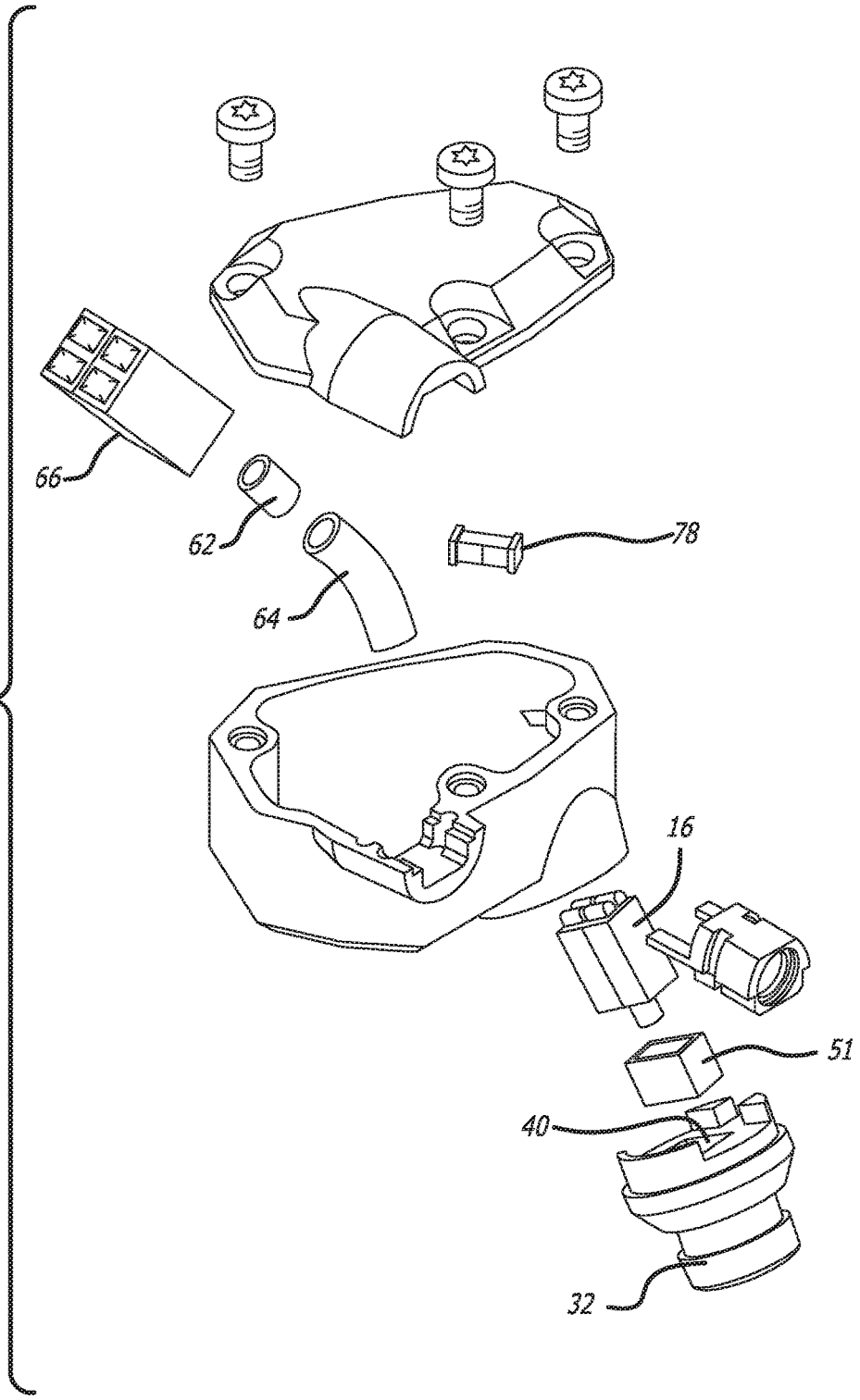
FIG. 2 is an exploded, front perspective view of a second embodiment in-ear monitor with a dual high frequency armature driver and a dual low frequency armature driver.

Looking at FIG. 2 it can be seen that the second embodiment in-ear monitor has a crossover component 78 operationally connected to a dual high frequency balanced armature driver 16 with a single cavity resonator box 51 affixed about the dual outlet sound slit ports. The resonator box 51 sits in the resonator box cavity 40 in the spout 32. A dual low frequency balanced armature driver 66 has a sonic dampener 62 affixed about its single outlet sound port, fitted inside a sound tube 64 that is affixed into a recess in the spout 32. Here the sound frequency tuning of the in-ear monitor is accomplished adjusting the volume of the resonator box; the outlet orifice diameter of the resonator box; the sonic dampener screen mesh sizes; the placement of the sonic dampener in the sound tubes; and the length of the sound tubes.

Figure 3:
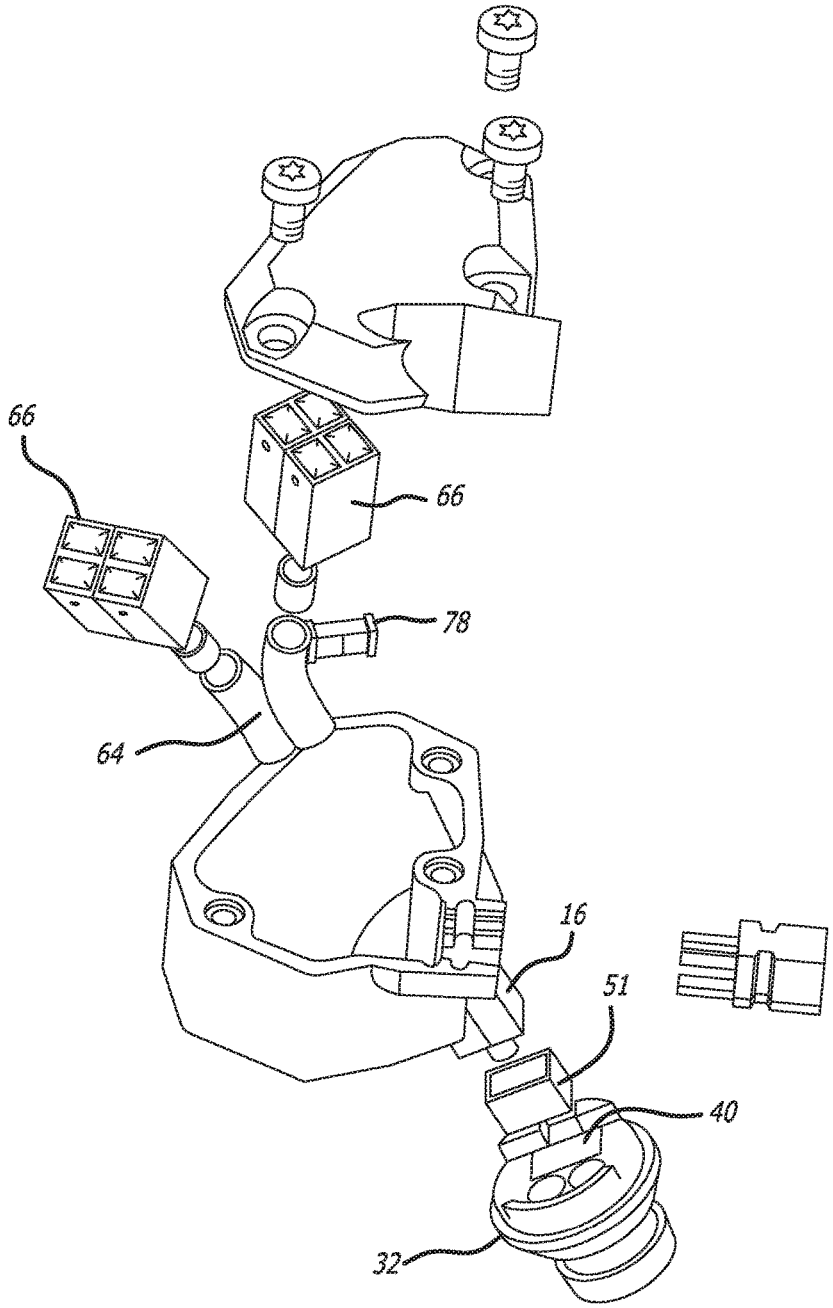
FIG. 3 is an exploded, front perspective view of a third embodiment in-ear monitor with a dual high frequency armature driver and two dual low frequency drivers.

Looking at FIG. 3 it can be seen that the third embodiment in-ear monitor differs from the second embodiment in that it utilizes two dual low frequency balanced armature drivers 66 connected into the spout 32 rather than just one. Here the sound frequency tuning of the in-ear monitor is accomplished adjusting the volume of the resonator box 51; the outlet orifice diameter of the resonator box; the sonic dampeners screen mesh sizes; the length of the sound tubes 64; and the placement of the sonic dampener in the sound tubes.

Looking at FIG. 4 it can be seen that the fourth embodiment utilizes two dual low frequency balanced armature drivers 66 and one full frequency balanced armature driver 60 all connected through sonic dampeners 62 and sound tubes 64 onto the stanchions 38 extending from the spout 32, and two dual high frequency high frequency drivers—connected to a dual driver yoke resonator box 50 connected to a sound tube 64 affixed to a stanchion 38 on the spout 32. Here the sound frequency tuning of the in-ear monitor is accomplished adjusting the volume of the yoke resonator box; the outlet orifice diameter of the resonator box; the sonic dampener screen mesh sizes; the length of the sound tubes; and the placement of the sonic dampener in the sound tubes.

Figure 5:
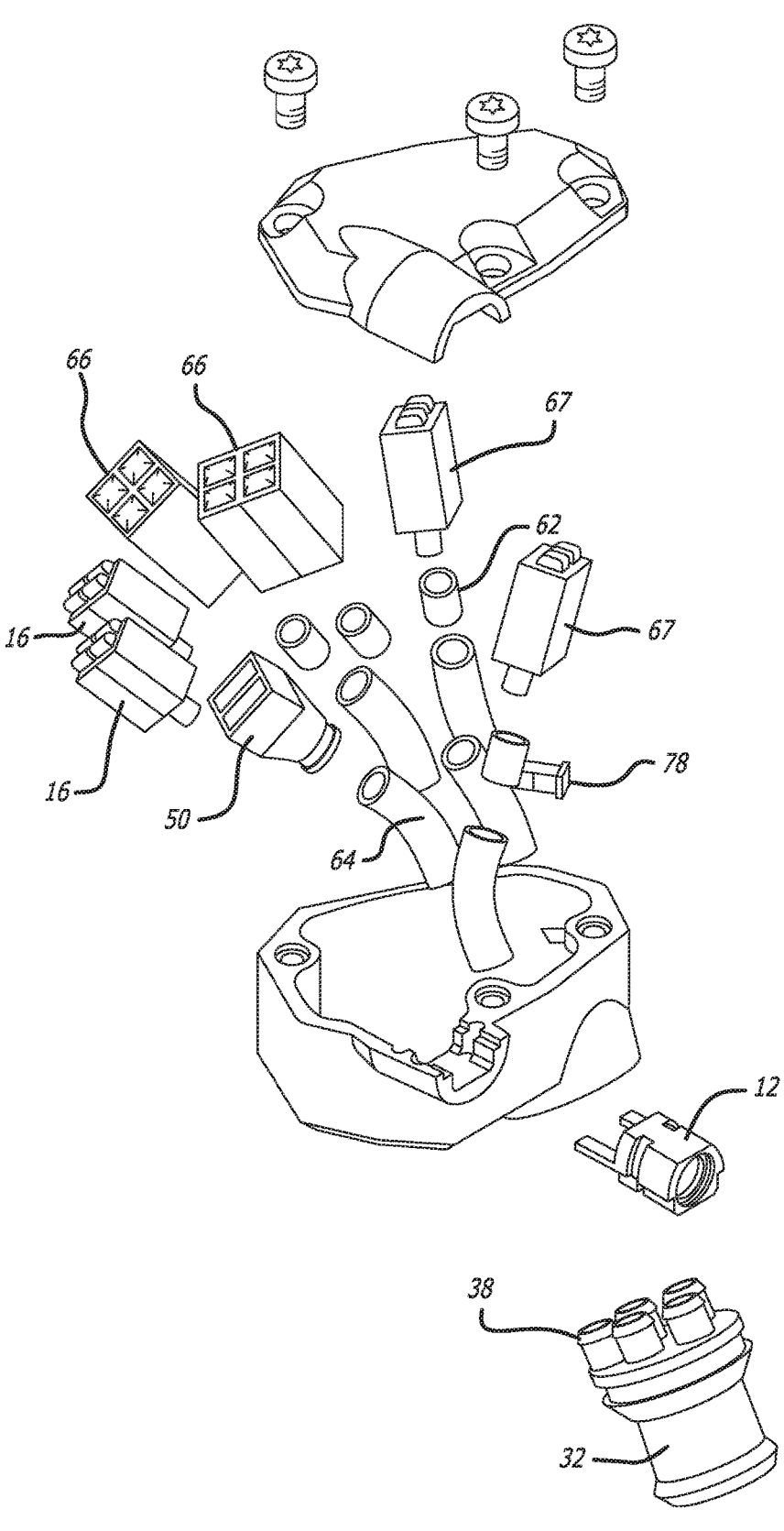
FIG. 5 is an exploded, front perspective view of a fifth embodiment in-ear monitor with a two dual high frequency armature drivers, two dual low frequency drivers and a two mid range frequency drivers.

Looking at FIG. 5 it can be seen that the fifth embodiment in-ear monitor has two dual high frequency balanced armature drivers 16, two mid frequency driver 67, two dual balanced armature low frequency drivers 68 and an additional stanchion 38 on the spout 32 for connection. The sound frequency tunability here is the same as for the previous embodiment.

Figure 6:
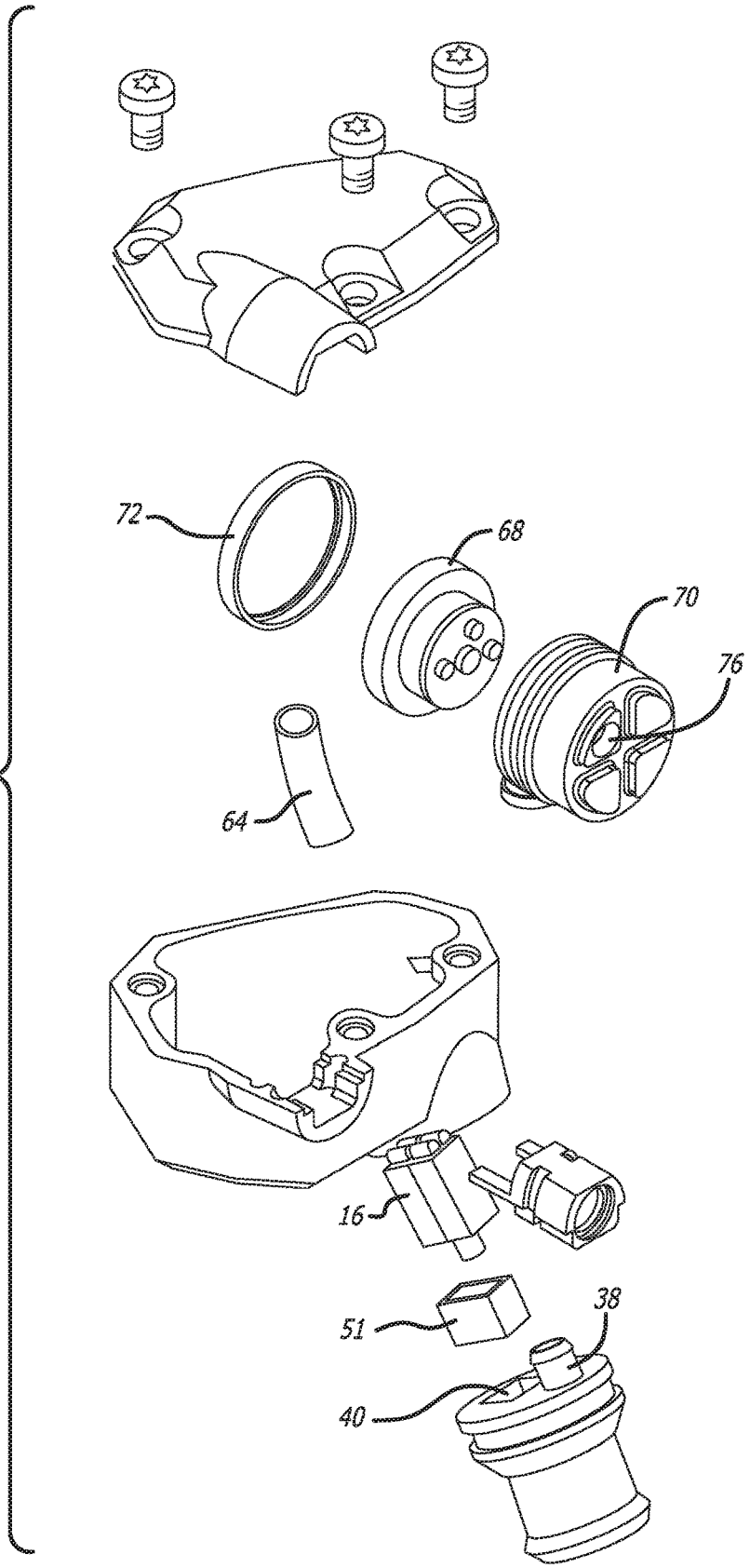
FIG. 6 is an exploded, front perspective view of a sixth embodiment in-ear monitor with a dual high frequency armature driver and a single dynamic low frequency driver.

Looking at FIG. 6 it can be seen that this embodiment utilizes a single low frequency low frequency dynamic driver 68 coupled to a sound tube 64 connected to a stanchion 38 in a spout 32, and a dual high frequency balanced armature driver 16 coupled to a resonator box 51 frictionally mounted into a resonator box cavity 40 in a spout 32. Here the sound frequency tuning of the in-ear monitor is accomplished adjusting the volume of the resonator box; the outlet orifice diameter of the resonator box; the diameter of the dynamic driver back pressure port; the dynamic driver back pressure port screen mesh sizes; the length of the sound tubes; and the placement of the sonic dampener in the sound tubes.

Looking at FIG. 7, the seventh embodiment in-ear monitor is identical to the sixth embodiment except it adds an additional dual low frequency balanced armature driver 66 that is coupled to a sonic dampener 62 and a sound tube 64, where both of the low frequency drivers sound tubes are mounted on stanchions 38 of the spout 32. Here the sound frequency tuning of the in-ear monitor is accomplished adjusting the volume of the resonator box; the outlet orifice diameter of the resonator box; the diameter of the dynamic driver back pressure port; the dynamic driver back pressure port screen mesh sizes; the and the length of the sound tubes; the sonic dampener screen mesh size; and the placement of the sonic dampener in the sound tubes.

Figure 8:
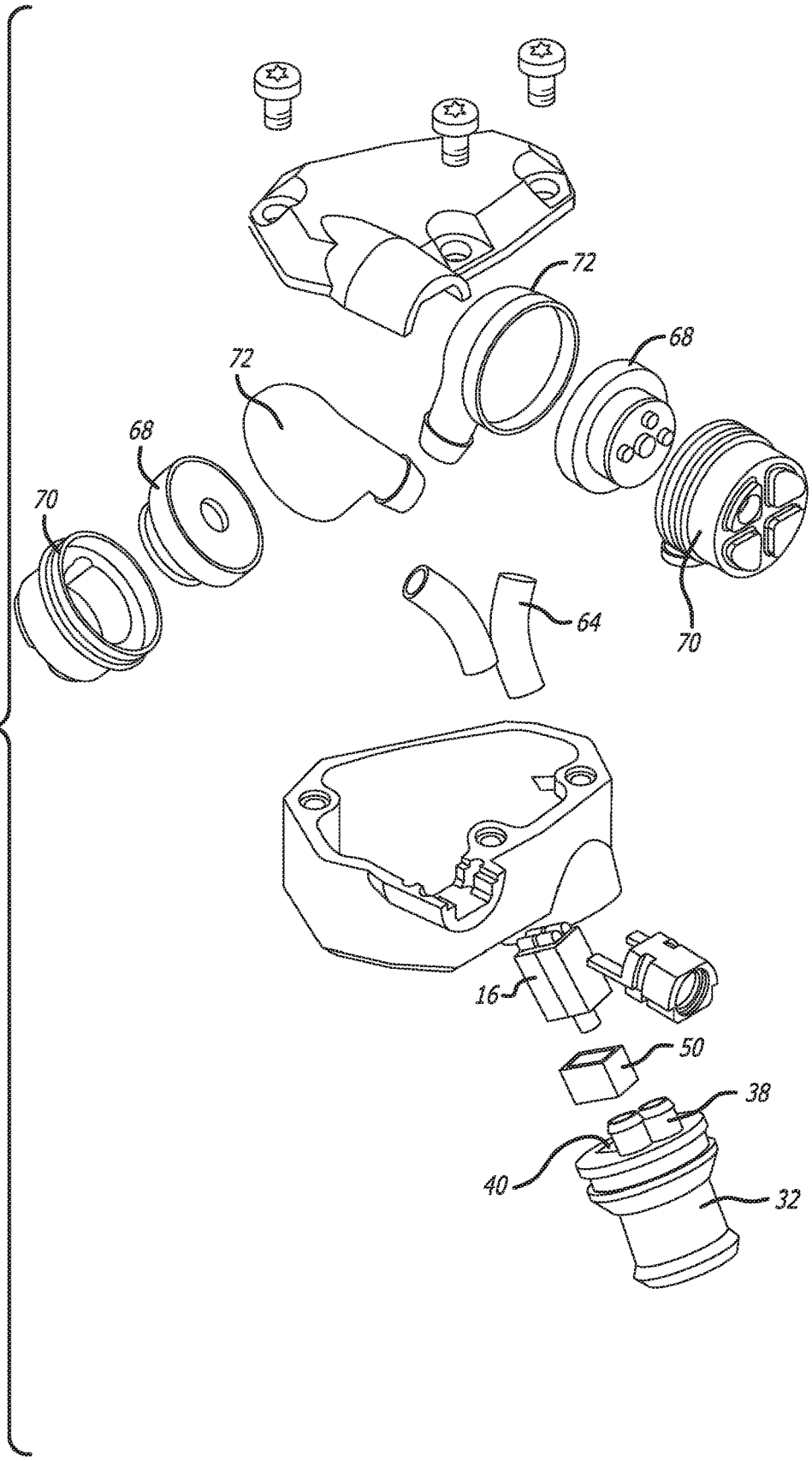
FIG. 8 is an exploded, front perspective view of an eighth embodiment in-ear monitor with a high frequency armature drivers and two low frequency dynamic drivers.

Looking at FIG. 8 it can be seen that the eight embodiment in-ear monitor utilizes two low frequency dynamic drivers 68 and a dual balanced armature high frequency driver 16. Here the sound frequency tuning of the in-ear monitor is accomplished adjusting the volume of the resonator box; the outlet orifice diameter of the resonator box; the diameter of the dynamic driver back pressure port; the dynamic driver back pressure port screen mesh sizes; and the length of the sound tubes.

Looking at FIG. 22, the ninth embodiment, it an be seen that this differs from FIG. 3 in that it utilizes a mid range driver instead of the second dual low range frequency driver. Here the sound frequency tuning of the in-ear monitor is accomplished adjusting the volume of the resonator box; the outlet orifice diameter of the resonator box; the length of the sound tubes and the placement of the sonic dampener in the sound tubes.

As discussed herein, the tunable aspect of the in-ear monitor is accomplished by adjusting any one or any combination of the following. The volume of the resonator box; the outlet orifice diameter of the resonator box; the sonic dampener screen mesh sizes; the dynamic driver back pressure port diameter, the dynamic driver back pressure port screen mesh sizes; and the length of the sound tubes; and the placement of the sonic dampener in the sound tubes. This is accomplished by making successive iterations of incremental changes to the five aforementioned parameters. Since the changes to the low frequency drivers affect the frequency response generally below 250 Hz and the changes to the high frequency drivers affect the frequency response generally above 4000 Hz, they can be changed simultaneously. Changes to the full range balanced armature driver must be performed alone.

Testing of the in-ear monitors basically measures the monitor's ability to generate a volume of sound across a range of given input frequencies that simulate the range of audible frequencies the human ear can detect. Evaluation of the frequency response of the in-ear monitors requires a testing body shaped like a human head having a pair of microphones imbedded therein an ear canal configured passage at the same position that human eardrums would reside. These microphones mimic the exact acoustic impedance characteristics of the inner ear canal. This system is placed in a chamber with stiff walls to provide significant acoustic resistance. The concept is to provide a measurement of exactly what is heard at the eardrum, isolating the outside noise activity.

The in-ear monitors are placed in the ear canal and the high frequency driver's, crossover component and low frequency driver and any full range frequency driver are connected to receive audio signals from a frequency generator. (Alternatively, because of the short distance between the sound outlet ports of the spout and the eardrums, the microphones can be directly coupled to the output of the in-ear monitors. This type of testing though, ignores the personal differences in sound due to modal artifacts typically involving peaks at 3 k HZ, 9 k Hz and 15 kHz, because of the ear size and the ear canal shape.) The amplitude (reference level volume) of the in-ear monitor's output is set at approximately 90-94 dB SPL for a test tone of 500 Hz.

The frequency generator inputs a frequency sweep signal to the in-ear monitors generally across the 20 Hz to 20 kHz range in numerous logarithmic increments. Commonly there is 500 plus increments with 511 used as a common number. The microphones capture the amplitude of the sound output from the in-ear monitors at the various frequency increments, amplify this and send this raw frequency response to the audio analyzer. The industry standard audio sound analyzer is an Audio Precision System™ Two Cascade model SYS-2522A. This records and plots the amplitude vs the frequency response on a logarithmic graph showing the amplitude of sound generated by the in-ear monitors at each of the 500 plus input frequency increments.

Figure 21:
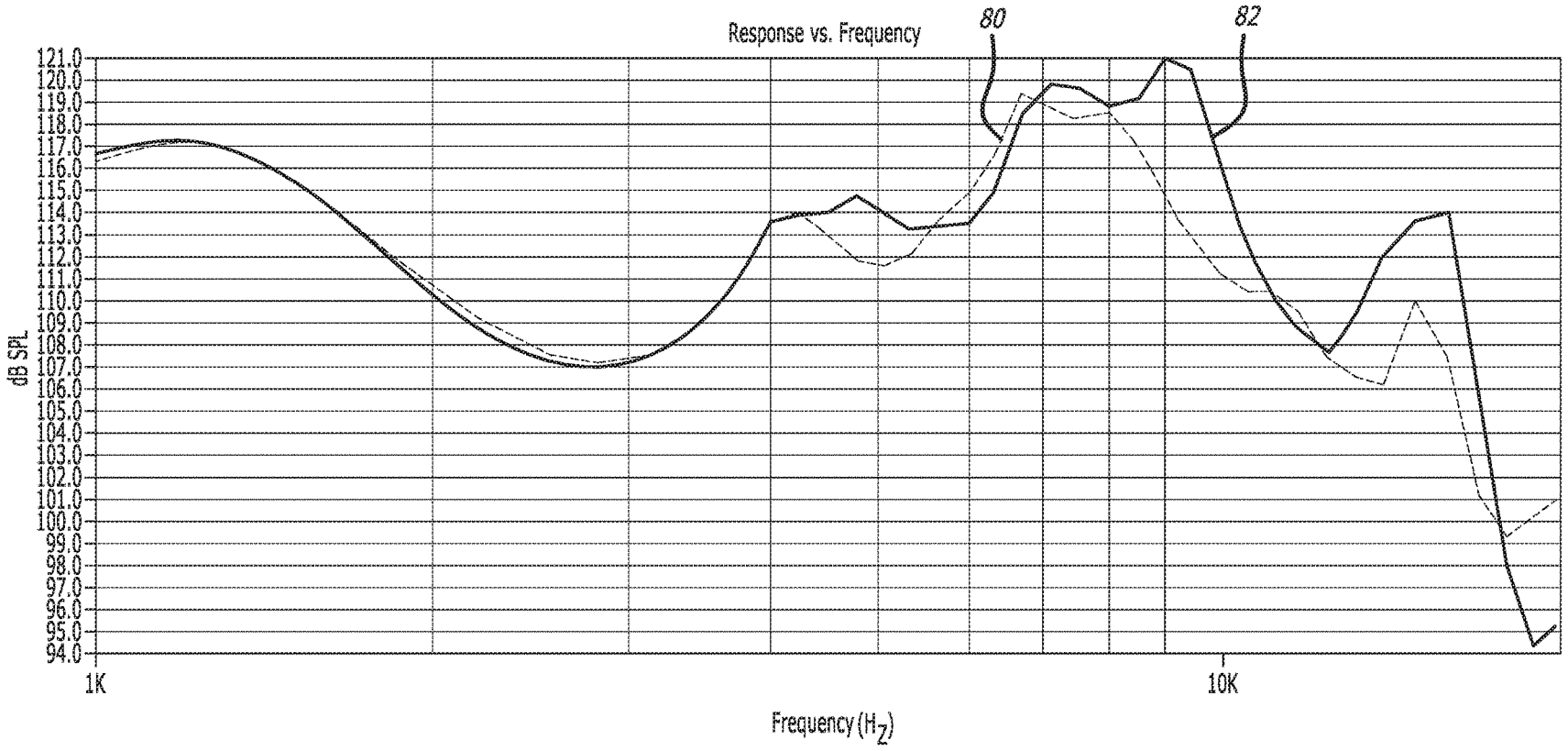
FIG. 21 is a Frequency Response chart showing the enhanced efficiency (frequency response) of a high frequency tuned in-ear monitor.

When making physical changes in the volume and outlet orifice size of the resonator box, or the dampener screen mesh size, the dynamic driver back pressure port, the dynamic driver back pressure port screen mesh sizes or the length of the sound tubes, a greater area under the trace of the amplitude of the frequency response graph, and the higher the peaks are compared to the baseline measurements to reflect the improvements in the frequency response of the in-ear monitors. Looking at FIG. 21 the comparison of a tuning of the high frequency drivers with and without a resonator box is provided. The baseline frequency response for a 50 Hz to 20,000 Hz frequency sweep is shown by the dotted line 80. The frequency response for a 50 Hz to 20,000 Hz frequency sweep performed on the same in-ear monitor with a resonator box is shown by the solid line 82. The frequency response increase between 7,000 Hz-12,000 Hz and 14,000 Hz-19,000 Hz is reflected in the area between the two traces in these frequency ranges.

The method of optimizing the in-ear monitor involves characterizing the frequency response of an in ear monitor with an input signal traversing the audio frequency spectrum from 20 Hz to 2000 kHz using a frequency analyzer. First, the desired drivers and crossover components for that in-ear monitor are selected for inclusion into the optimization tests. In the initial run there will be no resonator box directly coupled to the output sound end of any high frequency drivers, there will be no screens in the sonic dampener or the dynamic driver back pressure port of any low frequency drivers, and the length of the sound tubes will be the maximum that can be physically accommodated within the in-ear enclosure. The tuning will be accomplished by making successive iterations of incremental changers to the five aforementioned parameters.

Initially, the frequency generator output will be coupled to the in-ear monitor's circuit and will generate and input a broad spectrum audio signal covering at least the frequency range of 20 Hz to 20,000 Hz (a frequency sweep.) The microphones will pick up the sound generated by the various drivers and it will be amplified and sent into the spectrum analyzer that will digitally store and provide a graphic trace of the volume sensitivity response vs the input audio frequency. This will generate a graph of the in-ear monitor's baseline frequency response performance similar to that indicated by line 80 in the graph of FIG. 21.

Next, at least one of the tunable parameters discussed above will be changed and the identical frequency response sweep repeated. For purposes of this example, it will be the volume of the resonator box 51 coupled to the high frequency driver 16. The resultant spectrum analyzer trace will be overlaid onto the new trace. The differences in the peaks and the area under the traces of the frequency responses (the increases amount of produced sound from the high frequency driver in the frequency ranges between 4,000 HZ and 20,000 kHz) will be noted.

The test will be repeated making successive iterations with the successive iterations of different resonator box volumes. The trace showing the greatest increase in the frequency response will indicate the best tuned configuration. It is to be noted that the volume may be changed by adjusting the depth or the width of the resonator box as well as the geometric configuration. (Although a square, rectangular configuration has been used for the production of the graphs of FIG. 21, it is known that polygonal, circular and elliptical side wall configurations may be used.) To further tune the high frequency driver 16, successive iterations of the orifice in the resonator box may be tested with the optimally tuned resonator box volume and the same general testing protocol performed to achieve the optimal resonator box orifice for the best high frequency driver frequency response. Now a successive set of frequency response sweep tests can be performed with the sonic dampener placed at differing lengths in the sound tubes. Lastly with these three features optimized, a successive set of frequency response sweep tests can be performed, shortening the maximum length sound tubes with the optimally tuned resonator box volume and orifice size.

With the high frequency driver and its sound tube optimally tuned, further tests using successive iterations of the screen mesh sizes and diameters of the back pressure ports for the low and full frequency dynamic drivers may similarly be performed. After this, the low frequency sound tubes are evaluated as above. In this manner, the in-ear monitor may be optimally tuned for the best frequency response available from the dynamic low frequency drivers 66.

Where balanced armature low frequency drivers and/or mid range and/or full range frequency drivers are used, successive frequency response tests are performed with different mesh screen sizes of the dampener screens. Again, once their frequency responses are optimized, the optimal configuration is again run through successive iterations of frequency response tests with differing lengths of sound tubes.

Although discussed as a complete optimal sound frequency balancing across the entire 20 Hz to 20,000 Hz range for all frequencies of drivers, This is not necessary. Often an in-ear monitor may be designated for a specific genre of music and the optimal frequency response in all ranges may not be desirable. In such cases only the desired frequencies need be optimally tuned.

While certain features and aspects have been described with respect to exemplary embodiments, one skilled in the art will recognize that numerous modifications are possible. For example, the methods and processes described herein may be implemented using hardware components, software components, and/or any combination thereof. Further, while various methods and processes described herein may be described with respect to particular structural and/or functional components for ease of description, methods provided by various embodiments are not limited to any particular structural and/or functional architecture, but instead can be implemented on any suitable hardware, firmware, and/or software configuration. Similarly, while certain functionality is ascribed to certain system components, unless the context dictates otherwise, this functionality can be distributed among various other system components in accordance with the several embodiments.

Moreover, while the procedures of the methods and processes described herein are described in a particular order for ease of description, unless the context dictates otherwise, various procedures may be reordered, added, and/or omitted in accordance with various embodiments. Moreover, the procedures described with respect to one method or process may be incorporated within other described methods or processes; likewise, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although several exemplary embodiments are described above, it will be appreciated that the invention is intended to cover all modifications and equivalents within the scope of the following claims.

Having thus described the invention, what is claimed as new and desired to be secured by Letters Patent is as follows:

1. An in-ear monitor that produces sound when operationally connected to an external audio source comprising:

an in-ear monitor housing having an in-ear portion and an outward facing portion;

a spout disposed at the in-ear portion of the housing and a sound exit port;

a driver responsive to an electrical input to generate audible sound, disposed in the housing and having a first outlet sound port mechanically coupled to the spout so as to transfer sound generated from the driver into the sound exit port; and a resonator box disposed within the housing and inserted and matingly engaged into a recess in the spout, the resonator box having an opposing side wall structure having an open proximal end and a distal end wall with an orifice therethrough, the orifice concentric with the first outlet sound port, and directly affixed to the first outlet sound port.

2. The apparatus of claim 1 wherein the resonator box is integral with the spout.

3. The in-ear monitor of claim 1 wherein the resonator box has a volume adjusted to alter frequency characteristics of exiting sound.

4. The in-ear monitor of claim 1 wherein the driver is a high frequency balanced armature driver.

5. The in-ear monitor of claim 4 further comprising a low frequency dynamic driver unconnected to the resonator box.

6. The in-ear monitor of claim 1 further comprising a set of mechanically coupled low frequency drivers sharing a common low frequency sound output.

7. The in-ear monitor of claim 1 wherein the resonator box has a fully open face at a first end and a planar face at a second end.

8. The in-ear monitor of claim 1 further comprising a second driver unconnected to the resonator box.

9. The in-ear monitor of claim 1 wherein the resonator box comprises a rectangular cube.

10. The in-ear monitor of claim 1 wherein the resonator box has one fully open face and an opposing planar face having a sizeable orifice formed there through sized for mating engagement within the spout.

11. The in-ear monitor of claim 1 wherein the resonator box comprises a dual driver yoke.

12. The in-ear monitor of claim 11 wherein the resonator box includes a central wall dividing an open interior into a first volume and a second volume.

13. The in-ear monitor of claim 12 comprising a second driver disposed in the housing and having a second outlet sound port mechanically coupled to the spout so as to transfer sound generated from the driver into the sound exit port, wherein the second outlet port is directly affixed to the second volume and the first outlet port is directly affixed to the first volume.

14. The in-ear monitor of claim 13 wherein the driver and the second driver are mechanically coupled high frequency drivers.

15. The in-ear monitor of claim 14 further comprising a low frequency driver unconnected to the resonator box.

16. The in-ear monitor of claim 12 comprising a Y cavity providing a common sound tube for the first volume and the second volume.

* * * * *